US010278899B2

(12) United States Patent
Wang

(10) Patent No.: US 10,278,899 B2
(45) Date of Patent: May 7, 2019

(54) DEVICE FOR CUTTING MEDICINE TABLET

(71) Applicant: Yu-Chien Wang, Taichung (TW)

(72) Inventor: Yu-Chien Wang, Taichung (TW)

( * ) Notice: Subject to any disclaimer, the term of this patent is extended or adjusted under 35 U.S.C. 154(b) by 594 days.

(21) Appl. No.: 15/076,979

(22) Filed: Mar. 22, 2016

(65) Prior Publication Data

US 2017/0273868 A1 Sep. 28, 2017

(51) Int. Cl.

| | |
|---|---|
| ***A61J 7/00*** | (2006.01) |
| ***B26D 1/00*** | (2006.01) |
| ***B26D 1/02*** | (2006.01) |
| ***B26D 1/03*** | (2006.01) |
| ***B26D 3/24*** | (2006.01) |
| ***B26D 3/30*** | (2006.01) |
| ***B26D 5/10*** | (2006.01) |
| ***B26D 7/06*** | (2006.01) |

(52) U.S. Cl.

CPC ..... *A61J 7/0007* (2013.01); *B26D 1/02* (2013.01); *B26D 1/03* (2013.01); *B26D 3/24* (2013.01); *B26D 3/30* (2013.01); *B26D 5/10* (2013.01); *B26D 7/0608* (2013.01); *B26D 2001/0033* (2013.01)

(58) Field of Classification Search

CPC ..... A61J 7/0007; B26D 1/01; B26D 1/02; B26D 1/03; B26D 1/04; B26D 1/06; B26D 1/11; B26D 1/46; B26D 1/547; B26D 3/24; B26D 3/245; B26D 3/30; B26D 5/10; B26D 7/0608; B26D 2001/0033

USPC ..... 241/101.4, DIG. 27, 169.1

See application file for complete search history.

(56) References Cited

U.S. PATENT DOCUMENTS

| | | | | |
|---|---|---|---|---|
| 5,118,021 A * | 6/1992 | Fiocchi | ..... | A61J 7/0007 225/103 |
| 5,634,272 A * | 6/1997 | Samuelson | ..... | A47J 43/26 30/120.2 |
| 2008/0223893 A1* | 9/2008 | Petrie | ..... | A61J 7/0007 225/39 |

* cited by examiner

*Primary Examiner* — Shelley M Self

*Assistant Examiner* — Jared O Brown

(74) *Attorney, Agent, or Firm* — Muncy, Geissler, Olds & Lowe, P.C.

(57) ABSTRACT

A device for cutting a medicine tablet includes a base extending along an axis, a cutting device having a fixed cutter and a movable cutter base, and a carrying plate movably disposed inside the base and having a carrying face for a medicine tablet. The fixed cutter is fixedly disposed inside the base, the movable cutter base is optionally positionably moves between protruding and retreating positions axially, the movable cutter base has a movable cutter, when the movable cutter is in the protruding position, a blade of the movable cutter is near a blade of the fixed cutter, and when the movable cutter base is in the retreating position, the blade of the movable cutter is remote from the blade of the fixed cutter. The carrying face faces the blade of the fixed cutter and is able to approach the blade of the fixed cutter.

9 Claims, 7 Drawing Sheets

DEVICE FOR CUTTING MEDICINE TABLET

BACKGROUND OF THE INVENTION

Field of the Invention

The present invention relates to a device for cutting a medicine tablet, and more particularly to device for cutting a medicine tablet into halves or quarters.

Description of the Prior Art

A device for cutting a medicine tablet includes an inclined medicine-placing platform and a cutting blade pivoted to each other. When a medicine tablet to be cut is placed on the inclined medicine-placing platform, the cutting blade cuts downward, and the medicine tablet to be cut is cut into halves. This type of devices for cutting a medicine tablet are disclosed in TW175018 and TWM381400.

However, in this type of prior arts, the medicine tablet cannot be cut into quarters. If a user wants to cut the medicine tablet into quarters, the user needs to rotate the medicine tablet to another angle by hand and repeat the cutting motion again. In addition, the medicine tablet which is cut into halves cannot be positioned firmly so that the cutting blade cannot cut the halves of the medicine tablet again precisely.

The present invention has arisen to mitigate and/or obviate the afore-described disadvantages.

SUMMARY OF THE INVENTION

The major object of the present invention is to provide a device for cutting a medicine tablet, wherein a user can choose to cut the medicine tablet into halves or quarters once.

To achieve the above and other objects, a device for cutting a medicine tablet is provided, including a base, a cutting device and a carrying plate. The base extends along an axis. The cutting device has a fixed cutter and a movable cutter base, the fixed cutter is fixedly disposed inside the base, the movable cutter base optionally positionably moves between a protruding position and a retreating position axially, the movable cutter base has a movable cutter, when the movable cutter base is in the protruding position, a blade of the movable cutter is near a blade of the fixed cutter, and when the movable cutter base is in the retreating position, the blade of the movable cutter is remote from the blade of the fixed cutter. The carrying plate is for being operated and movably disposed inside the base, the carrying plate has a carrying face for carrying a medicine tablet, and the carrying face faces the blade of the fixed cutter and is able to approach the blade of the fixed cutter optionally.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
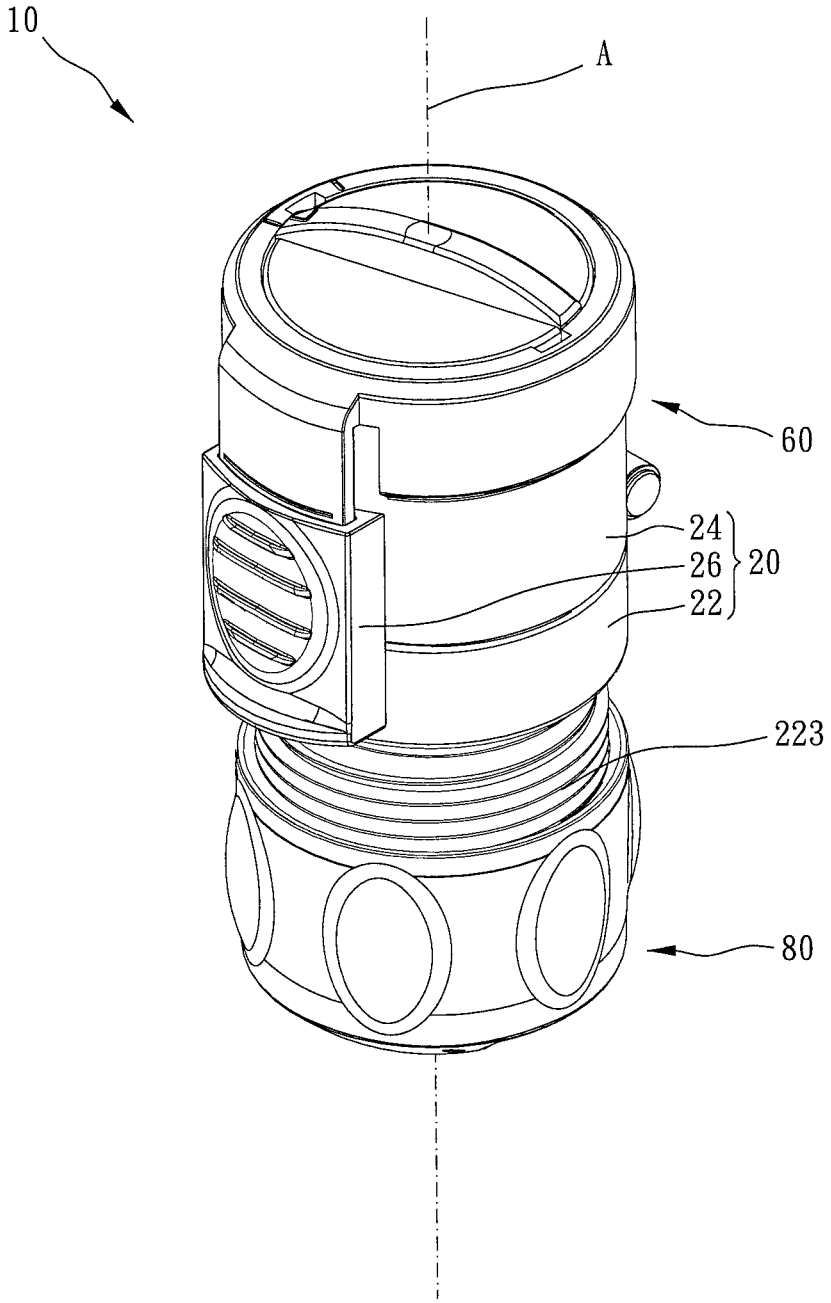
FIG. 1 is a perspective view of a preferred embodiment of a device for cutting a medicine tablet of the present invention.

The present invention will be clearer from the following description when viewed together with the accompanying drawings, which show, for purpose of illustrations only, the preferred embodiment in accordance with the present invention.

Please refer to FIGS. 1 to 10 for a preferred embodiment of the present invention. A preferred embodiment of a device for cutting a medicine tablet 10 is used to cut or grind a medicine tablet 12. As shown in FIGS. 1 to 4, the device for cutting a medicine tablet 10 includes a base 20, a carrying plate 30, a cutting device 40, a fixed cutter 41, a movable cutter base 50, a movable cutter 51, a positioning member 60, two clasping elastic sheets 70, a rotational pushing base 80, a medicine-grinding cup 90 and a bottom cover 95.

The base 20 extends along an axis A and includes a lower annular base 22, an upper annular base 24 and a slidable clasping portion 26, an exterior wall surface of the lower annular base 22 near the upper annular base 24 has two lower sliding tracks 221 and a clasping groove 222, the two lower sliding tracks 221 extend axially parallel to each other, the clasping groove 222 is located between the two lower sliding tracks 221, the lower annular base 22 remote from the upper annular base 24 has an exterior threaded portion 223, and an interior wall surface of the lower annular base 22 is formed with two axial ribs 229 parallel to each other.

The upper annular base 24 is pivoted to the lower annular base 22 and arranged with the lower annular base 22 coaxially, an exterior wall surface of the upper annular base 24 has two upper sliding tracks 241 and a clasping block 242, the two upper sliding tracks 241 and the two lower sliding tracks 221 of the lower annular base 22 are connected with each other coaxially, the clasping block 242 is detachably clasped in the clasping groove 222 of the lower annular base 22, and the slidable clasping portion 26 is slidably arranged on the upper sliding track 241.

Figure 4:
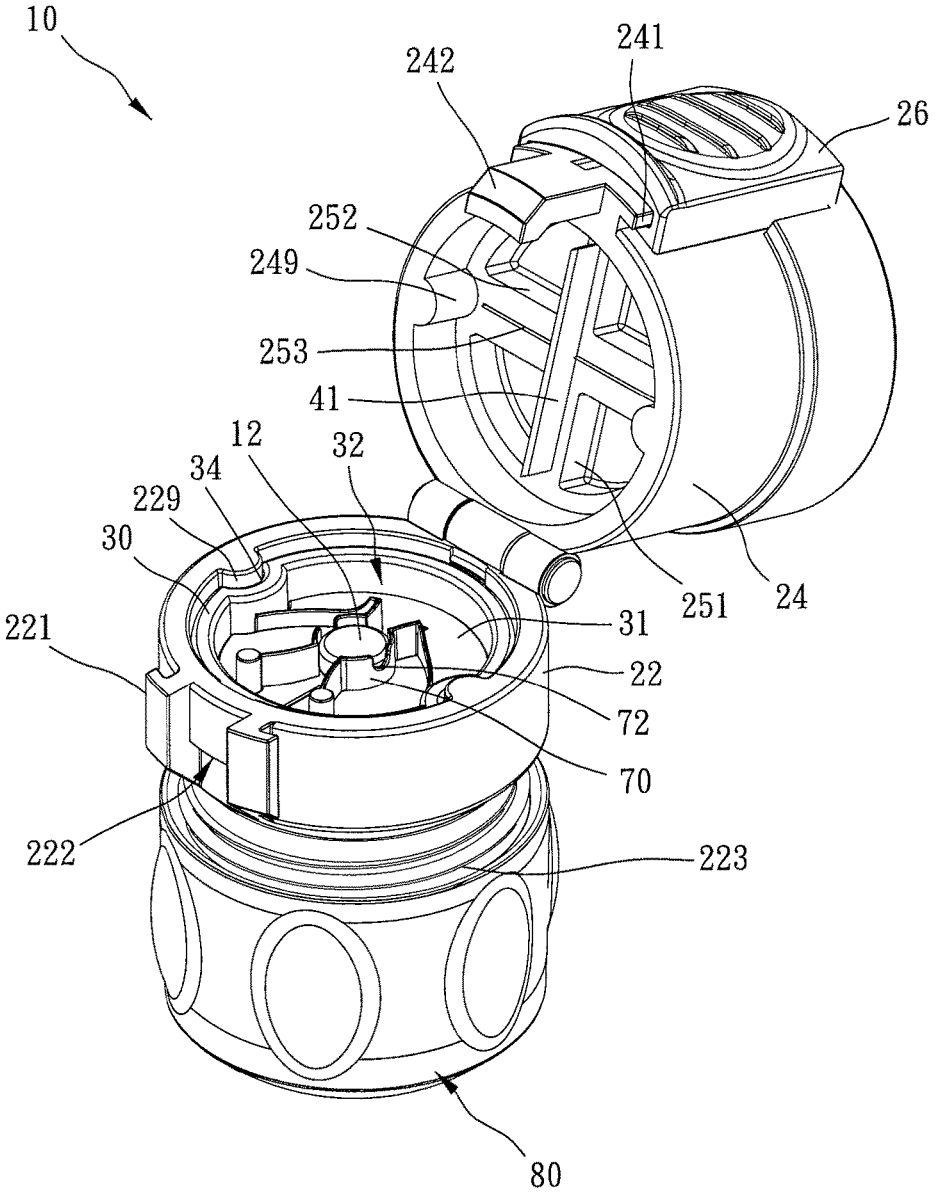
FIG. 4 is a drawing showing that a medicine tablet is placed in a base of the device for cutting the medicine tablet according to a preferred embodiment of the present invention.

The lower annular base 22 and the upper annular base 24 are pivoted to each other, so a user can open or close the base 20 freely, as shown in FIGS. 1 and 4, to put in or take out the medicine tablet 12. When the base 20 needs to be locked, the user can push the slidable clasping portion 26 from the upper sliding track 241 to the lower sliding track 221 when the clasping block 242 is clasped in the clasping groove 222 so that the sliding clasping portion 26 covers the clasping block 242 to restrict the clasping block 242 from deforming elastically and prevent the clasping block 242 from being dislocated from the clasping groove 222.

Figure 2:
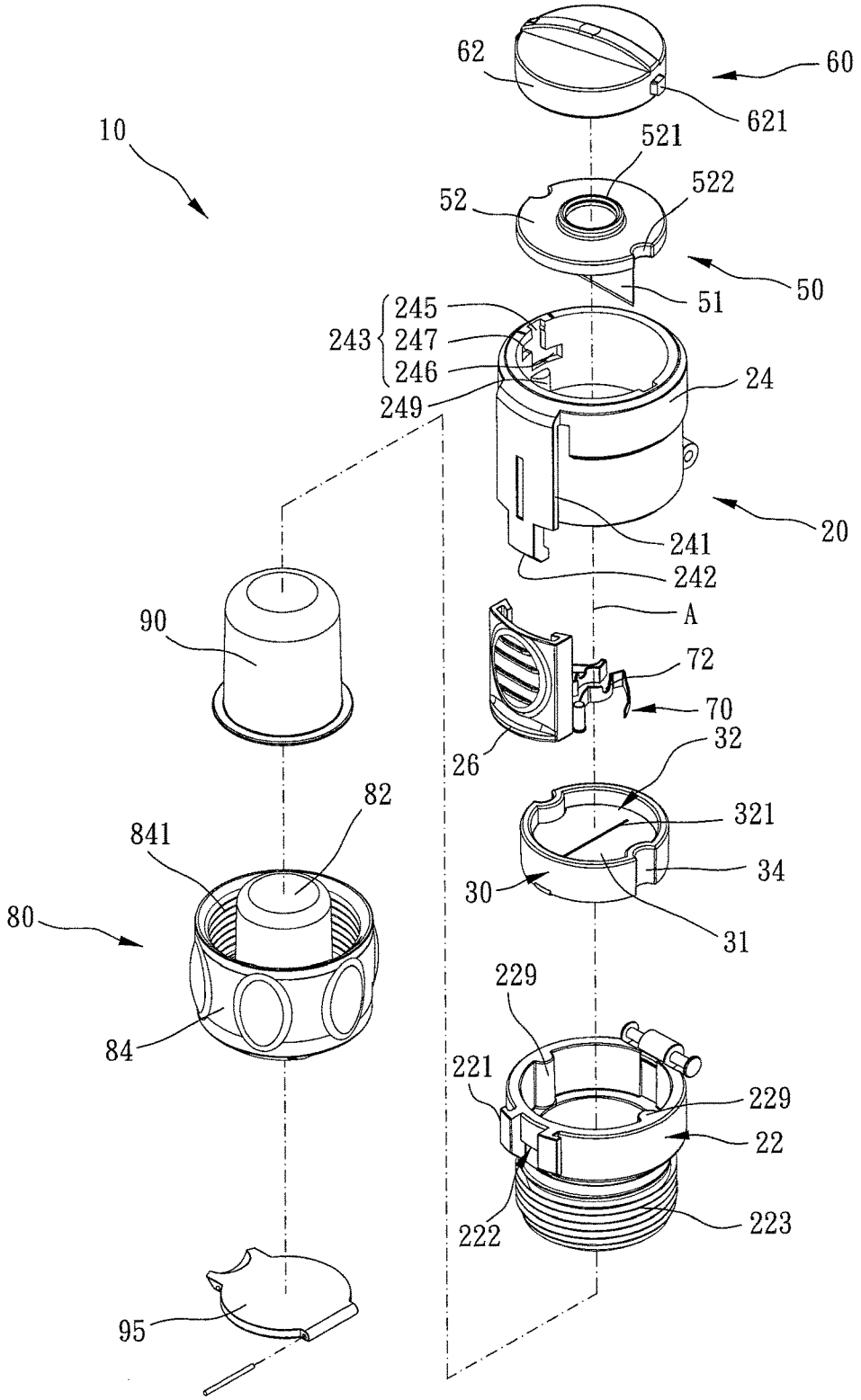
FIG. 2 is a breakdown view of the preferred embodiment of the device for cutting a medicine tablet of the present invention.

An interior wall surface of the upper annular base 24 remote from the lower annular base 22 has two positioning guiding grooves 243 symmetrical to each other relative to the axis A (as shown in FIG. 2), each of said positioning guiding grooves 243 has an axial portion 245, a first lateral portion 246 and a second lateral portion 247, and the axial portion 245 extends axially and is connected with the first lateral portion 246 and the second lateral portion 247. In addition, the interior wall surface of the upper annular base 24 near the lower annular base 22 further has two axial ribs 249, the axial ribs 249 of the upper annular base 24 are connected with the axial ribs 229 of the lower annular base 22 coaxially.

Figure 3:
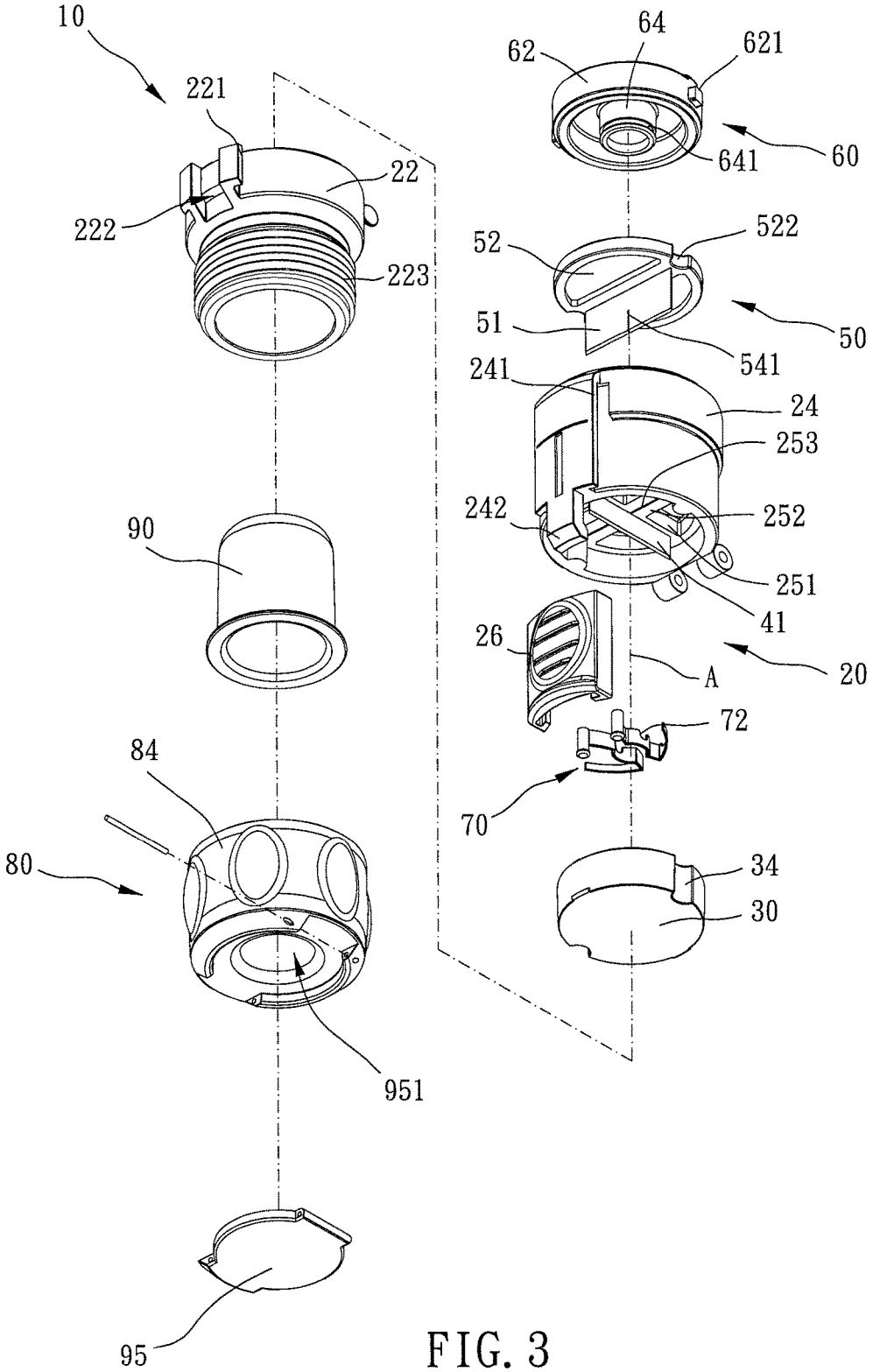
FIG. 3 is a breakdown view of the preferred embodiment of the device for cutting a medicine tablet of the present invention viewed from another angle.

In addition, an interior of the upper annular base 24 is further formed with a first radial rod 251 and a second radial rod 252 perpendicular to each other (as shown in FIGS. 3 and 4), the second radial rod 252 has a through slit 253, and the through slit 253 penetrates through the second radial rod 252.

The cutting device 40 has the fixed cutter 41 and the movable cutter base 50, and the fixed cutter 41 is fixedly arranged on the first radial rod 251 inside the base 20 (as shown in FIGS. 3 and 4).

Figure 8:
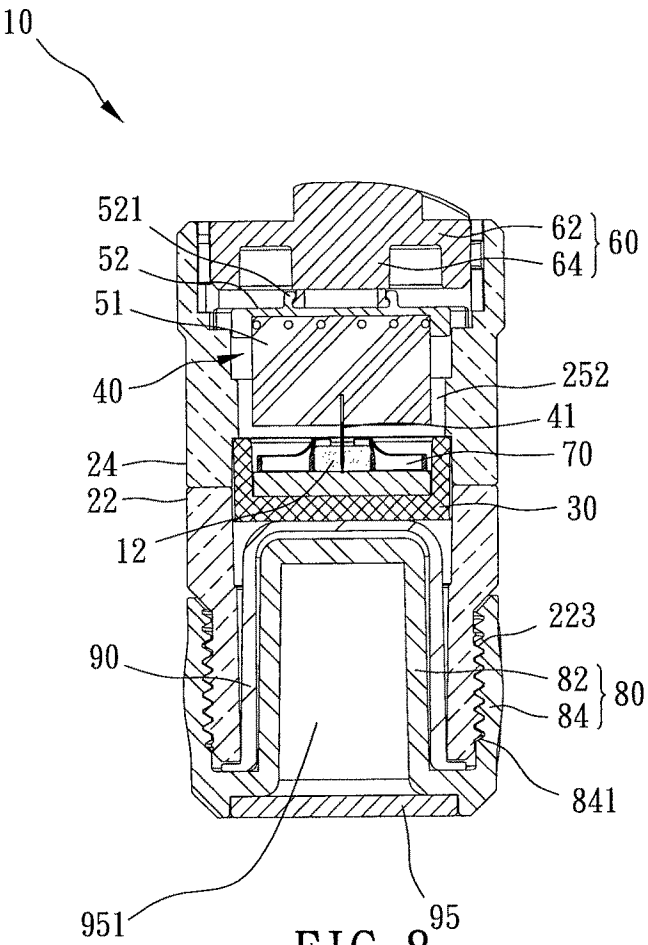
FIGS. 7 and 8 are cross-sectional drawings showing that the device for cutting a medicine tablet is cutting the medicine tablet into halves according to a preferred embodiment of the present invention.
Figure 7:
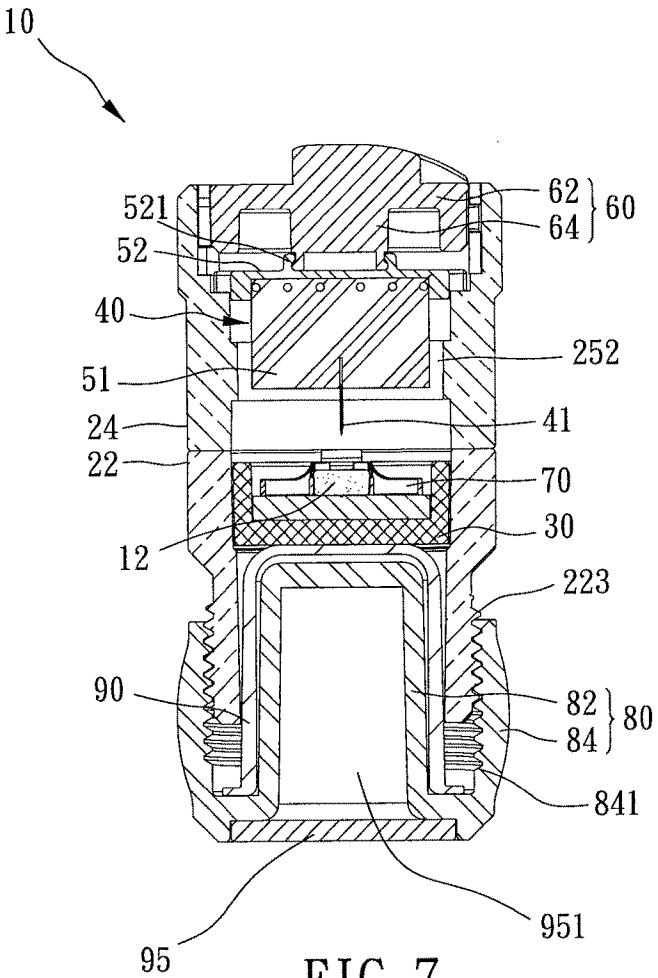
Figure 10:
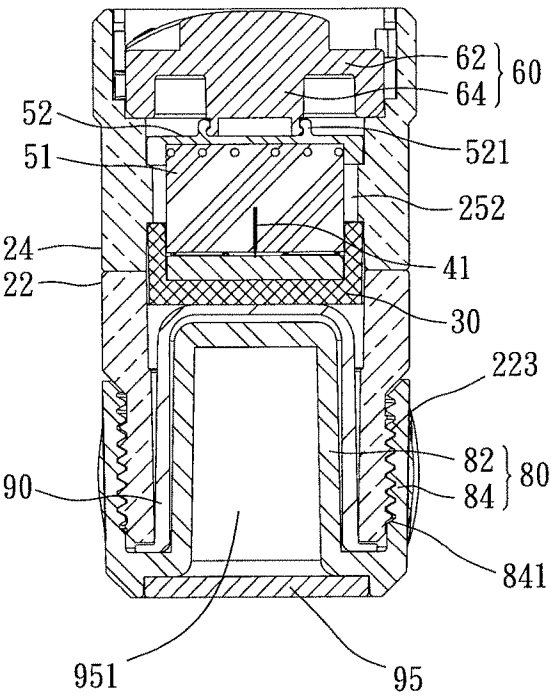
FIGS. 9 and 10 are cross-sectional drawings showing that the device for cutting a medicine tablet is cutting the medicine tablet into quarters according to a preferred embodiment of the present invention.
Figure 9:
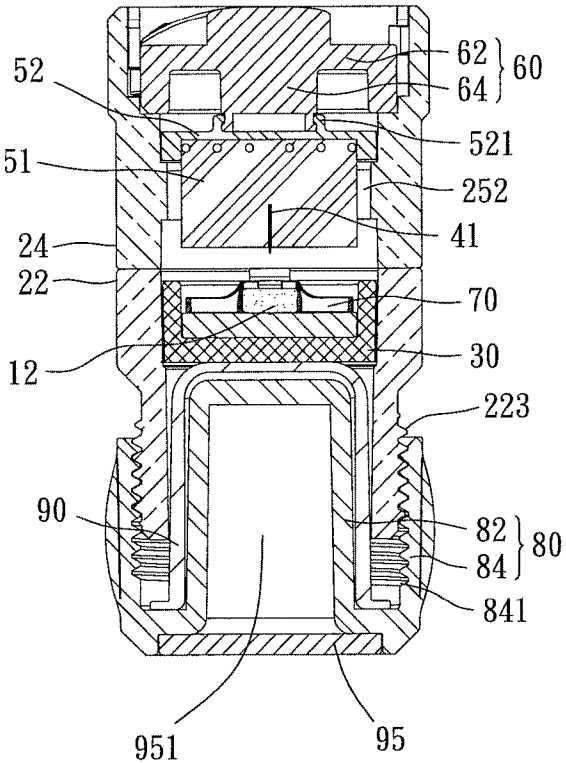

The movable cutter base 50 optionally positionably moves between a protruding position (as shown in FIGS. 9 and 10) and a retreating position (as shown in FIGS. 7 and 8) axially, the movable cutter base 50 has a movable cutter 51, when the movable cutter base 50 is in the protruding position, a blade of the movable cutter 51 is near a blade of the fixed cutter 41, and when the movable cutter base 50 is in the retreating position, the blade of the movable cutter 51 is remote from the blade of the fixed cutter 41. Specifically, the movable cutter base 50 is further provided with a round plate portion 52 and the positioning member 60, the positioning member 60 is connected with the movable cutter 51, a side of the round plate portion 52 is formed with an annular rib 521, another side of the round plate portion 52 is provided with the movable cutter 51, a circumferential face of the round plate portion 52 includes two notches 522, the two notches 522 are for receiving the axial ribs 249 of the upper annular base 24 so that the movable cutter base 50 can move axially along the axial ribs 249, the movable cutter 51 is inserted in the through slit 253 of the second radial rod 252 of the base 20 (as shown in FIG. 3), and the blade of the movable cutter 51 is perpendicular to the blade of the fixed cutter 41. More specifically, the movable cutter 51 has a slit 541 located on the axis A, when the movable cutter base 50 is in the retreating position, as shown in FIG. 4, the movable cutter base 50 is hidden in the through slit 253 of the second radial rod 252 and does not function, and the fixed cutter 41 cuts the medicine tablet 12 into halves; when the movable cutter base 50 is in the protruding position, the movable cutter base 50 protrudes outside the second radial rod 252, the fixed cutter 41 is inserted in the slit 541 of the movable cutter 51, and the movable cutter 51 and the fixed cutter 41 together cut the medicine tablet 12 into quarters.

The positioning member 60 is movably arranged on the upper annular portion 24 of the base 20 for being connected with the movable cutter 51 so as to keep the movable cutter base 50 in the protruding position or the retreating position; the positioning member 60 includes a round cover 62 and an axial protrusion 64, a circumferential face of the round cover 62 has two protrusions 621, the two protrusions 621 are received in the positioning guiding groove 243 of the upper annular base 24 of the base 20, when the movable cutter base 50 is in the protruding position, the two protrusions 621 are received in the first lateral portion 246 of the positioning guiding groove 243, when the movable cutter base 50 is in the retreating position, the two protrusions 621 are received in the second lateral portion 247; and the axial protrusion 64 is integrally connected with the round cover 62 and has an annular groove 641 for receiving the annular rib 521 so that the movable cutter 51 can move axially with the positioning member 60, and the positioning 60 can rotate relative to the movable cutter 51.

The carrying plate 30 is for being operated and movably disposed inside the base 20, the carrying plate 30 has a carrying face 31 for carrying the medicine tablet 12, and the carrying face 31 faces the blade of the fixed cutter 41 and is able to approach the blade of the fixed cutter 41 optionally. Specifically, the carrying face 31 has a corresponding slit 321, and the corresponding slit 321 corresponds to the fixed cutter 41. When carrying out a cutting motion, the fixed cutter 41 is inserted in the corresponding slit 321 so that the blade of the fixed cutter 41 cut the medicine tablet completely. In addition, the corresponding slit 321 allows the user to know where s/he should place the medicine tablet 12 on so that the cutting device 40 can cut the medicine tablet 12 into parts with a same dimension precisely. More specifically, the carrying plate 30 is further formed with a receiving groove 32 for the medicine tablet 12 to be put therein, and a circumferential face of the carrying plate 30 includes two notches 34, and the two notches 34 are for receiving the axial ribs 229 of the lower annular base 22 and the axial ribs 249 of the upper annular base 24 so that the carrying plate 30 can move axially along the axial ribs 229, 249.

The two clasping elastic sheets 70 are received in the receiving groove 32 of the carrying plate 30 and abut against an interior wall surface of the receiving groove 32 to fixedly clasp the medicine tablet 12 when the medicine tablet 12 is put into the receiving groove 32, each said clasping elastic sheet 70 has a recess 72, and the recesses 72 correspond to the movable cutter 51 so as to receive the movable cutter 51.

The rotational pushing base 80 has an inner barrel portion 82 and an outer annular portion 84, the inner barrel portion 82 abuts against the carrying plate 30 via the medicine-grinding cup 90, the outer annular portion 84 is arranged with the inner barrel portion 82 coaxially and has an interior threaded portion 841 which is meshable with an exterior threaded portion 223 of the lower annular base 22 of the base 20, and the medicine-grinding cup 90 is cylindrical and received in and among the inner barrel portion 82 and the outer annular portion 84 of the rotational pushing base 80, the base 20 and the carrying plate 30.

The bottom cover 95 is pivoted to the outer annular portion 84 of the rotational pushing base 80, and the bottom cover 95 and the inner barrel portion 82 of the rotational pushing base 80 define a receiving space 951 for receiving one or more medicine tablet(s) 12.

Figure 6:
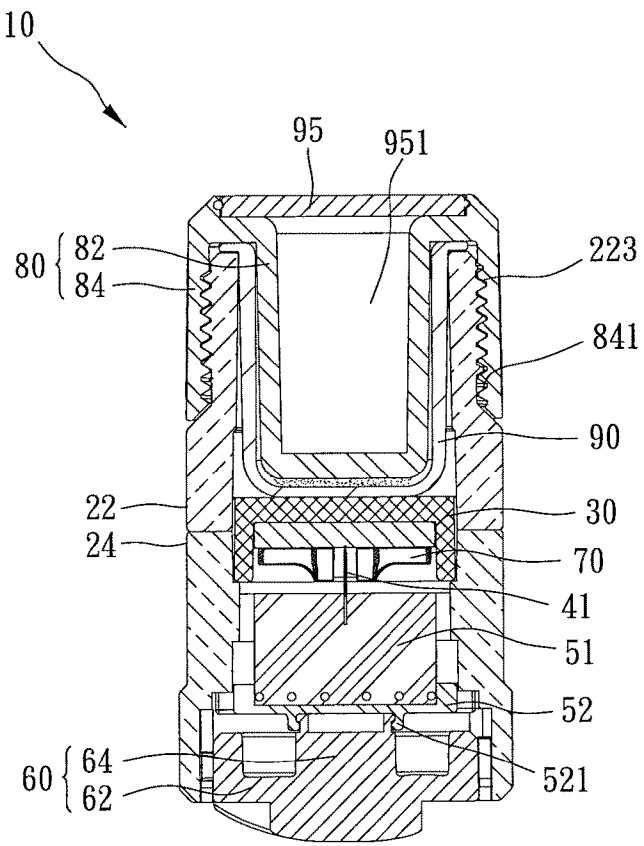
FIGS. 5 and 6 are cross-sectional drawings showing the device for cutting a medicine tablet in grinding a medicine tablet according to a preferred embodiment of the present invention.
Figure 5:
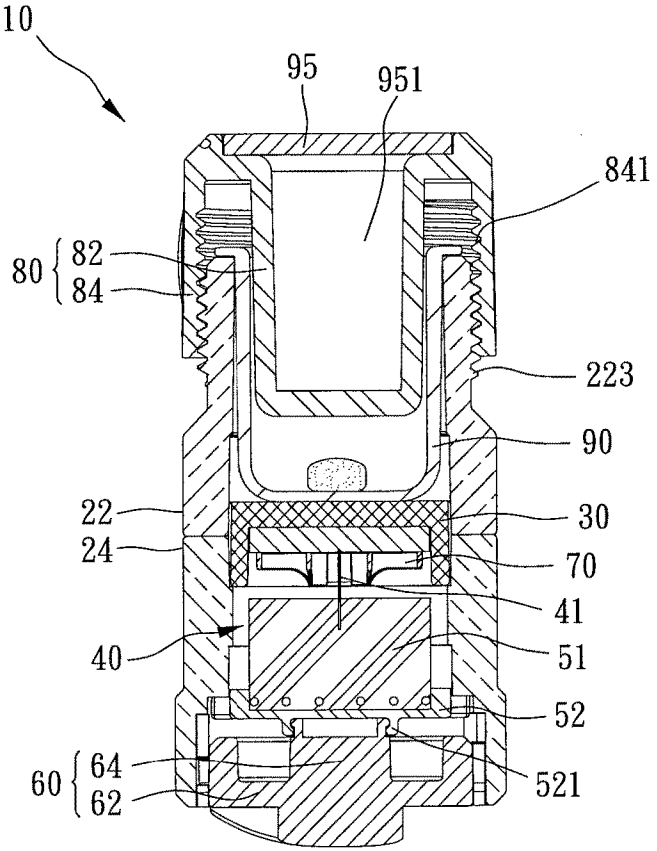

Through the above-mentioned structure, when the user wants to grind the medicine tablet 12 into powder, s/he can rotate the rotational pushing base 80 to dislocate the rotational pushing base 80 from the base 20, put the medicine tablet 12 into the medicine-grinding cup 90, and rotate the rotational pushing base 80 back into the base 20 (as shown in FIG. 5). In the meanwhile, as the user continues to rotate the rotational pushing base 80 into the base 20, the inner barrel portion 82 of the rotational pushing base 80 and the medicine-grinding cup 90 rotatably squeeze and press the medicine tablet 12 (as shown in FIG. 6), and the medicine tablet 12 is gradually ground into powder for people who cannot swallow the medicine tablet smoothly.

When the user wants to cut the medicine tablet 12, s/he needs to open the base 20 (as shown in FIG. 4), put the medicine tablet 12 into the receiving groove 32 of the carrying plate 30, clasp the medicine tablet 12 with the two clasping elastic sheets 70 and close the base 20. If the user needs to cut the medicine tablet 12 into halves, s/he needs to rotate and axially move the positioning member 60 so as to make the protrusion 621 move into the second lateral portion 247 of the positioning guiding groove 243 of the base 20. In this moment, as shown in FIG. 7, the movable cutter base 50 is in the retreating position, and the movable cutter 51 is remote from the fixed cutter 41. Then, the user continues to rotate the rotational pushing base 80 into the base 20, the inner barrel portion 82 of the rotational pushing base 80 abuts against and pushes the carrying plate 30 toward the fixed cutter 41 via the medicine-grinding cup 90, and the fixed cutter 41 contacts and cuts the medicine tablet 12 (as shown in FIG. 8). In addition, if the user needs to cut the medicine tablet 12 into quarters, s/he also needs to rotate and axially move the positioning member 60 so as to make the protrusion 621 move into the first lateral portion 246 of the positioning guiding groove 243 of the base 20 and to make the movable cutter base 50 be in the protruding position (as shown in FIG. 9) so that the blade of the movable cutter 51 approaches the blade of the fixed cutter 41. Then, the user only needs to rotate the rotational pushing base 80 into the base 20 to complete the cutting process (as shown in FIG. 10).

Given the above, in the present invention, through keeping the movable cutter base in the protruding position or the retreating position, the user can optionally cut the medicine tablet into halves or quarters once.

In addition, the medicine-grinding cup and the rotational pushing base are provided. The user can put the medicine tablet into the medicine-grinding cup and grind the medicine tablet into powder with the rotational pushing base.

While we have shown and described various embodiments in accordance with the present invention, it should be clear to those skilled in the art that further embodiments may be made without departing from the scope of the present invention.

What is claimed is:

1. A device for cutting a medicine tablet, including: a base, extending along an axis;

a cutting device, having a fixed cutter and a movable cutter base, the fixed cutter fixedly disposed inside the base, the movable cutter base being adjustably positioned between a protruding position and a retreating position, the movable cutter base having a movable cutter, when the movable cutter base is in the protruding position, a blade of the movable cutter is near a blade of the fixed cutter, and when the movable cutter base is in the retreating position, the blade of the movable cutter is remote from the blade of the fixed cutter;

a carrying plate, for being operated and movably disposed inside the base, the carrying plate having a carrying face for carrying the medicine tablet, the carrying face facing the blade of the fixed cutter and being able to approach the blade of the fixed cutter; wherein the base has two positioning guiding grooves symmetrical to each other relative to the axis, each of said positioning guiding grooves has an axial portion, a first lateral portion and a second lateral portion, the axial portion extends axially and is connected with the first lateral portion and the second lateral portion, the movable cutter base is further provided with a positioning member connected with the movable cutter, the positioning member has two protrusions which are received in the two positioning guiding grooves respectively, when the movable cutter base is in the protruding position, the two protrusions are received in the first lateral portion, and when the movable cutter base is in the retreating position, the two protrusions are received in the second lateral portion.

2. The device for cutting a medicine tablet according to claim 1, wherein the movable cutter has a slit located on the axis, and when the movable cutter base is in the protruding position, the fixed cutter is inserted in the slit.

3. The device for cutting a medicine tablet according to claim 1, wherein the movable cutter base is further provided with a round plate portion, a side of the round plate portion is formed with an annular rib, another side of the round plate portion is provided with the movable cutter, the positioning member has an annular groove, and the annular rib is received in the annular groove.

4. The device for cutting a medicine tablet according to claim 1, wherein the base has a lower annular base, an upper annular base and a slidable clasping portion, an exterior wall surface of the lower annular base has two lower sliding tracks and a clasping groove, the two lower sliding tracks extend parallel to each other, the clasping groove is located between the two lower sliding tracks, the upper annular base is pivoted to the lower annular base and arranged with the lower annular base coaxially, an exterior wall surface of the upper annular base has two upper sliding tracks and a clasping block, the two upper sliding tracks and the two lower sliding tracks are connected with each other coaxially, the clasping block is detachably clasped in the clasping groove, and the slidable clasping portion is slidably arranged on the upper sliding tracks.

5. The device for cutting a medicine tablet according to claim 1, wherein the carrying plate has a receiving groove for receiving the medicine tablet, the device for cutting a medicine tablet further has two clasping elastic sheets, the two clasping elastic sheets are received in the receiving groove and abut against an interior wall surface of the receiving groove so as to fixedly clasp the medicine tablet when the medicine tablet is put into the receiving groove, each said clasping elastic sheet has a recess, and the recesses correspond to the movable cutter.

6. The device for cutting a medicine tablet according to claim 1, further including a rotational pushing base, the rotational pushing base having an inner barrel portion and an outer annular portion, the inner barrel portion abutting against the carrying plate, the outer annular portion arranged with the inner barrel portion coaxially and having an interior threaded portion, the base having an exterior threaded portion and being meshable with the interior threaded portion of the outer annular portion.

7. The device for cutting a medicine tablet according to claim 6, wherein the inner barrel portion of the rotational pushing base abuts against the carrying plate via a medicine-grinding cup, and the medicine-grinding cup is cylindrical and received in and among the inner barrel portion and the outer annular portion of the rotational pushing base, the base and the carrying plate.

8. The device for cutting a medicine tablet according to claim 6, wherein the rotational pushing base further includes a bottom cover, the bottom cover is pivoted to the outer annular portion of the rotational pushing base, and the bottom cover and the inner barrel portion define a receiving space.

9. The device for cutting a medicine tablet according to claim 8, further including two clasping elastic sheets and a medicine grinding cup, wherein:

the base has a lower annular base, an upper annular base and a slidable clasping portion, an exterior wall surface of the lower annular base near the upper annular base has two lower sliding tracks and a clasping groove, the two lower sliding tracks extend axially parallel to each other, the clasping groove is located between the two lower sliding tracks, the lower annular base remote from the upper annular base has an exterior threaded portion, and an interior wall surface of the lower annular base is formed with two axial ribs parallel to each other; the upper annular base is pivoted to the lower annular base and arranged with the lower annular base coaxially, an exterior wall surface of the upper annular base has two upper sliding tracks and a clasping block, the two upper sliding tracks and the two lower sliding tracks of the lower annular base are connected with each other coaxially, the clasping block is detachably clasped in the clasping groove of the lower annular base, the slidable clasping portion is slidably arranged on the upper sliding tracks; an interior wall surface of the upper annular base remote from the lower annular base has the two positioning guiding grooves, the interior wall surface of the upper annular base near the lower annular base further has two axial ribs, the axial ribs of the upper annular base are connected with the axial ribs of the lower annular base coaxially; an interior of the upper annular base is further formed with a first radial rod and a second radial rod perpendicular to each other, the second radial rod has a through slit, the through slit penetrates through the second radial rod;

the carrying plate has a receiving groove for receiving the medicine tablet, the receiving groove has a corresponding slit, the corresponding slit corresponds to the fixed cutter, a circumferential face of the carrying plate includes two notches, the two notches are for receiving the axial ribs of the lower annular base and the axial ribs of the upper annular base;

the fixed cutter is arranged on the first radial rod inside the base;

the movable cutter base is further provided with a round plate portion, a side of the round plate portion is formed with an annular rib, another side of the round plate portion is provided with the movable cutter, a circumferential face of the round plate portion includes two notches, the two notches are for receiving the axial ribs of the upper annular base, the movable cutter is inserted in the through slit of the second radial rod of the base, the blade of the movable cutter is perpendicular to the blade of the fixed cutter, the movable cutter has a slit located on the axis, when the movable cutter base is in the protruding position, the fixed cutter is inserted in the slit of the movable cutter; the positioning member includes a round cover and an axial protrusion, a circumferential face of the round cover has the two protrusions; the axial protrusion is integrally connected with the round cover and has an annular groove for receiving the annular rib; the two clasping elastic sheets are received in the receiving groove of the carrying plate and abut against an interior wall surface of the receiving groove to fixedly clasp the medicine tablet, each said clasping elastic sheet has a recess, and the recesses correspond to the movable cutter; the inner barrel portion of the rotational pushing base abuts against the carrying plate via the medicine-grinding cup, the medicine-grinding cup is cylindrical and received in and among the inner barrel portion and the outer annular portion of the rotational pushing base, the base and the carrying plate.

* * * * *